US009070992B2

(12) United States Patent
Hemond et al.

(10) Patent No.: US 9,070,992 B2
(45) Date of Patent: Jun. 30, 2015

(54) TERMINATION OF CARBON NANOTUBE MACROSTRUCTURES

(71) Applicant: Tyco Electronics Corporation, Berwyn, PA (US)

(72) Inventors: Jessica Henderson Brown Hemond, Mifflintown, PA (US); Jerzy Gazda, Austin, TX (US); Zhengwei Liu, Houston, TX (US); Rodney Ivan Martens, Mechanicsburg, PA (US); Min Zheng, Harrisburg, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 97 days.

(21) Appl. No.: 13/669,817

(22) Filed: Nov. 6, 2012

(65) Prior Publication Data

US 2013/0217279 A1 Aug. 22, 2013

Related U.S. Application Data

(60) Provisional application No. 61/599,612, filed on Feb. 16, 2012.

(51) Int. Cl.

| | |
|---|---|
| ***H01R 11/03*** | (2006.01) |
| ***H01R 13/03*** | (2006.01) |
| ***H01R 4/18*** | (2006.01) |

(52) U.S. Cl.

CPC ..... *H01R 13/03* (2013.01); *H01R 4/188* (2013.01)

(58) Field of Classification Search

CPC ..... H01R 4/363; H01R 4/20

USPC ..... 439/791, 787, 805, 845, 784, 884, 885, 439/880, 433, 444

See application file for complete search history.

(56) References Cited

U.S. PATENT DOCUMENTS

| | | | | |
|---|---|---|---|---|
| 3,854,114 | A * | 12/1974 | Kloth et al. | 439/398 |
| 5,316,506 | A * | 5/1994 | Ito | 439/879 |
| 2001/0005647 | A1* | 6/2001 | Endo et al. | 439/203 |
| 2004/0020681 | A1* | 2/2004 | Hjortstam et al. | 174/102 SC |
| 2007/0202735 | A1* | 8/2007 | Hanks | 439/427 |
| 2010/0144205 | A1 | 6/2010 | Searfass | |
| 2010/0226061 | A1 | 9/2010 | Sutton et al. | |

FOREIGN PATENT DOCUMENTS

EP 2151894 A1 2/2010

OTHER PUBLICATIONS

PCT International Search Report dated Mar. 27, 2013 issued in the corresponding PCT application No. PCT/US2013/023526.

* cited by examiner

*Primary Examiner* — Phuongchi T Nguyen

(57) ABSTRACT

An electrical connector has a carbon nanotube (CNT) conductor, a terminal terminated to the CNT conductor, and a conductive intermediary electrically coupled to the CNT conductor and the terminal to enhance an electrical connection between the CNT conductor and the terminal. Optionally, the terminal may have a crimp barrel that receives the CNT conductor. The electrical connector may include a second CNT conductor where the terminal splices the CNT conductor and the second CNT conductor together.

10 Claims, 4 Drawing Sheets

TERMINATION OF CARBON NANOTUBE MACROSTRUCTURES

CROSS REFERENCE TO RELATED APPLICATIONS

This application claims the benefit of U.S. Provisional Application No. 61/599,612 filed on Feb. 16, 2012, the subject matter of which is herein incorporated by reference in its entirety.

BACKGROUND OF THE INVENTION

The subject matter herein relates generally to termination of carbon nanotube (CNT) macrostructures.

CNTs are carbon-based networks that have use in a wide range of applications. Due to the electrical conductivity exhibited by CNTs, CNTs have application in electrical systems, such as use as electrical conductors of cables, wires or other conductors, as electromagnetic interference (EMI) shielding for cables or other types of electronic components, and other applications. Due to the relative light weight of CNTs, as compared to traditional metal components, CNTs have application in aeronautical application where weight is a significant design factor.

CNTs for use as electrical conductors are not without disadvantages. For instance, termination of CNTs to terminals or other conductive elements or splicing of CNTs to other CNTs has proven difficult. A need remains for termination methods and components for termination CNTs.

BRIEF DESCRIPTION OF THE INVENTION

In one embodiment, an electrical connector is provided having a carbon nanotube (CNT) conductor, a terminal terminated to the CNT conductor, and a conductive intermediary electrically coupled to the CNT conductor and the terminal to enhance an electrical connection between the CNT conductor and the terminal. Optionally, the terminal may have a crimp barrel that receives the CNT conductor. The electrical connector may include a second CNT conductor where the terminal splices the CNT conductor and the second CNT conductor together.

Optionally, the conductive intermediary may be integrally formed with the crimp barrel. The conductive intermediary may include fins extending from the crimp barrel with CNT strands of the CNT conductor being laced between the fins. The conductive intermediary may include a conductive layer on at least one of the crimp barrel and the CNT conductor. The conductive layer may be malleable and formed into the CNT conductor when heat and/or pressure is applied to the conductive layer. The conductive intermediary may include a soft metal that conforms to and spreads into the CNT conductor. The conductive intermediary may include a conductive paste on at least one of the crimp barrel and the CNT conductor.

Optionally, the conductive intermediary may include conductive fillers in the CNT conductor between CNT strands of the CNT conductor that engage the terminal. The conductive intermediary may include a metallic wire received in the CNT conductor.

Optionally, the conductive intermediary may include a post extending from the terminal. The CNT conductor may be wrapped around the post and doubled back into the crimp barrel. The conductive intermediary may include openings in the crimp barrel through a body defining the terminal. The CNT conductor may be laced into and out of the crimp barrel through the openings.

Optionally, the terminal may be a multi-piece body with the CNT conductor being sandwiched between the pieces of the terminal. The terminal may include an inner body and an outer body. The outer body may have a wedge that is driven into an end of the CNT conductor to engage the CNT conductor. The inner body may have a screen with screen openings. CNT strands of the CNT conductor may be laced through the screen and sandwiched between the inner and outer bodies.

Optionally, the conductive intermediary may include blades with a gap therebetween extending from the terminal. The blades and the gap may define an insulation displacement contact with the CNT conductor being loaded into the gap and the blades engaging the CNT conductor. Interior surfaces of the blades may be made of soft metal that deforms and spreads into the CNT conductor between CNT strands of the CNT conductor.

DETAILED DESCRIPTION OF THE INVENTION

Embodiments described herein provide termination methods and components for CNT conductors. Embodiments have features that aid in providing an electrical and mechanical connection between a terminal and a CNT conductor.

Figure 1:
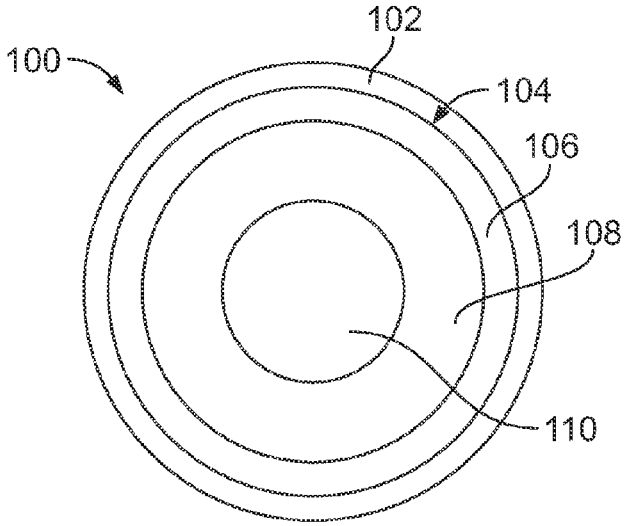
FIG. 1 is a cross-sectional view of a cable formed in accordance with an exemplary embodiment.

FIG. 1 is a cross-sectional view of a cable 100 formed in accordance with an exemplary embodiment. The cable 100 includes a jacket 102 defining a core 104. An EMI shield 106 is in the core 104 and is surrounded by the jacket 102. An insulator 108 is in the core 104 and is surrounded by the EMI shield 106. A center conductor 110 is in the core 104 and is surrounded by the insulator 108. The insulator 108 electrically isolates the center conductor 110 from the EMI shield 106. The insulator 108 is manufactured from a dielectric material. Optionally, the insulator 108 may be a shrink tube that is heat shrinkable. The jacket 102 is manufactured from a dielectric material. Optionally, the jacket 102 may be a shrink tube that is heat shrinkable. Optionally, the cable 100 may include a drain or ground wire.

The EMI shield 106 and the center conductor 110 are electrically conductive. The cable 100 defines a coaxial cable having the center conductor 110 and an outer conductor defined by the EMI shield 106 extending along a common axis along the length of the cable 100. The cable 100 may be another type of cable, such as a twin-axial cable, a quad-axial cable, an unshielded cable, and the like. The center conductor 110 is configured to convey electrical signals between a first end 112 (shown in FIG. 2) and a second end 114 (shown in FIG. 2) of the cable 100. In an exemplary embodiment, the center conductor 110 is configured to convey data signals. Alternatively, the center conductor 110 may convey power between the first and second ends 112, 114. In other alternative embodiments, the cable 100 may include more than one center conductors that define different electrical paths to convey different electrical signals.

In an exemplary embodiment, the center conductor 110 and the EMI shield 106 are manufactured from a carbon-based substrate, such as carbon nanotubes (CNTs). The CNTs faun a network that defines a CNT macrostructure, such as a wire, a tape, a foil, a braid, or other usable structure that may be handled and processed to manufacture the cable 100 or other electronic components. The CNT macrostructure is made of many CNT nanostructures. Other types of carbon-based substrates may include graphene, a graphite oxide structure, and the like. Alternatively, the center conductor 110 and the EMI shield 106 are manufactured into a macrostructure from another nano-substrate, such as a ceramic nanowire, such as a boron nitride substrate. The description hereinafter refers to the carbon-based substrate as a CNT network. The CNT network may be used in other types of electronic components other than a cable, such as a passive dielectric or insulating component. The CNT network may be modified to make a compounded or composite network having particles other than carbon nanotubes to enhance characteristics of the CNT macrostructure.

The center conductor 110 defines a CNT conductor, and may be referred to hereinafter as a CNT conductor 110. Optionally, the center conductor 110 may include one or more strands of CNT conductors that are twisted together during a cable forming process. Each strand may be a separate CNT conductor manufactured from a CNT network.

The EMI shield 106 defines a CNT conductor, and may be referred to hereinafter as a CNT conductor 106. In an alternative embodiment, only the center conductor 110 is manufactured from a CNT network. In another alternative embodiment, only the EMI shield 106 is manufactured from a CNT network.

The CNT network includes a plurality of CNT fibers that are arranged to form a framework that defines the CNT network. The framework may be pulled or drawn from a CNT array or CNT source, such as by using a spinning technique. The framework may be formed into a yarn or wire. The framework may be a braided yarn or a mesh. Alternatively, the framework may be formed into a tape. Alternatively, the framework may be formed into a sheet. The wire, tape or sheet may have any length depending on the particular application. A wire is defined as having a width that is less than approximately two times a thickness of the framework. A tape is defined as having a width that is greater than approximately two times the thickness of the framework and having a width that is less than approximately ten times the thickness of the framework. A sheet is defined as a framework having a width that is greater than approximately ten times the thickness of the framework. The framework may have different shapes depending on the particular application.

The wires or yarns may be used, for example, to define the strands of the center conductor 110. The tapes may be used, for example, to form the EMI shield 106, wherein the tape may be wrapped around the internal components of the cable 100 such that the opposite edges of the tape touch one another or overlap one another. In other embodiments, the tape may be wrapped in a helical manner around the insulator 108 and center conductor 110 to form an EMI shield. In other alternative embodiments, the tapes may be used to form wires or conductors of a cable, such as by drawing the tape during a cable forming process. The sheet may be used, for example, as an EMI shield that covers an electrical component, such as a housing of a connector to provide EMI shielding for the connector. The framework may have any other shape suitable for the particular application capable of being formed from a CNT structure.

In an exemplary embodiment, each CNT conductor 106, 110 is manufactured from a CNT network that is combined with fillers, such as metallic fillers, organometallic fillers, or other types of fillers, to form a composite conductor. The fillers may be used to enhance the ability to terminate the CNT conductor 106, 110. The fillers may be used to enhance an electrical characteristic or other characteristic of the CNT conductor 106, 110. The fillers may be particles, flakes, large bodies or structures suspended in or passing through the CNT conductors 106, 110, plating, encapsulated pellets, or other additives in or on the CNT conductors 106, 110.

In an exemplary embodiment, the fillers are applied by bathing the CNT network in a solvent bath that includes a solvent and the additive particles in the solution. The composite conductor is then processed to remove the solvent and/or react the additive particles with the CNT network. For example, the composite conductor may be subjected to heating, cooling, annealing, densifying, thickening, winding, plying, braiding, functionalizing and the like. The additive particles may be applied by other processes in alternative embodiments, such as physical vapor deposition, chemical vapor deposition, dip coating, or other processes to apply the additive particles to the CNT network. The fillers may extend or permeate entirely through the CNT network such that the fillers are between the fibers of the CNT network. The fillers may be a coating on or between individual fibers or yarns in a network or braid. The fillers may penetrate the fibers or yarns that make up the network or braid. In other embodiments, the CNT network may be inserted into an aqueous bath having additive particles in suspension rather than a solvent bath.

Figure 2:
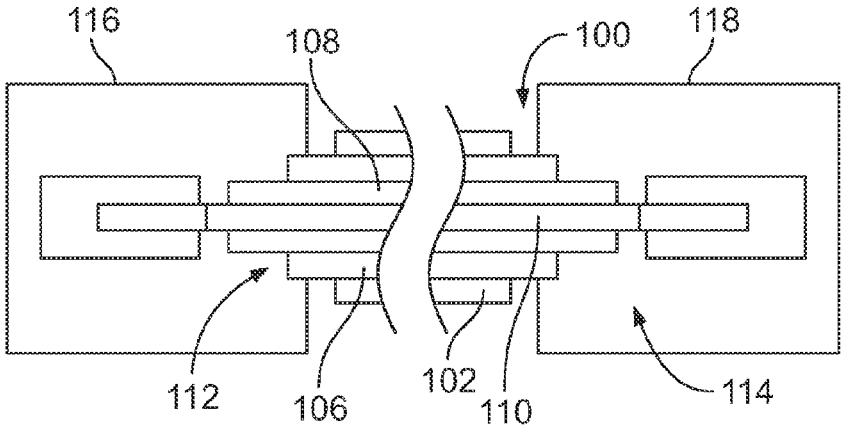
FIG. 2 illustrates a cable extending between a first end and a second end.

FIG. 2 illustrates the cable 100 extending between the first and second ends 112, 114. The cable 100 may have any length defined between the first and second ends 112, 114. The first end 112 is terminated to a first electrical component 116. The second end 114 is terminated to a second electrical component 118.

The first and second electrical components 116, 118 are represented schematically in FIG. 2. The first and second electrical components 116, 118 may be any type of electrical component. Optionally, the first electrical component 116 may be different than the second electrical component 118. The electrical components 116, 118 may be electrical contacts, electrical connectors, circuit boards, or other types of electrical components. In an exemplary embodiment, the first and/or second electrical components 116, 118 are crimped to the cable 100. The cable 100 may be terminated by other means or processes in alternative embodiments, such as soldering, welding, adhering, bonding and the like.

The center conductor 110 and/or EMI shield 106 are mechanically and electrically connected to the electrical components 116, 118. The center conductor 110 and/or EMI shield 106 create an electrical path between the first and second electrical components 116, 118.

In an exemplary embodiment, the CNT network of the CNT conductor is conductive and is configured to convey electrical signals between the first and second electrical components 116, 118. The fillers may enhance the electrical properties of the center conductor 110 and/or EMI shield 106. For example, the conductivity of the center conductor 110 and/or EMI shield 106 may be increased by selecting a filler material having a high conductivity. The fillers may be selectively located along the cable 100, such as proximate to the first and second ends 112, 114 to enhance the termination of the CNT network to the electrical components 116, 118. For example, the fillers may enhance the ability of the CNT network to be crimped to a terminal.

The cable 100 and electrical components 116, 118 define an electrical connector. The CNT network may be used in other types of electrical systems other than a cable. For example, the CNT network may be used in another type of electrical connector, a microprocessor, or any type of electrical component suitable for use with CNTs.

Figure 3:
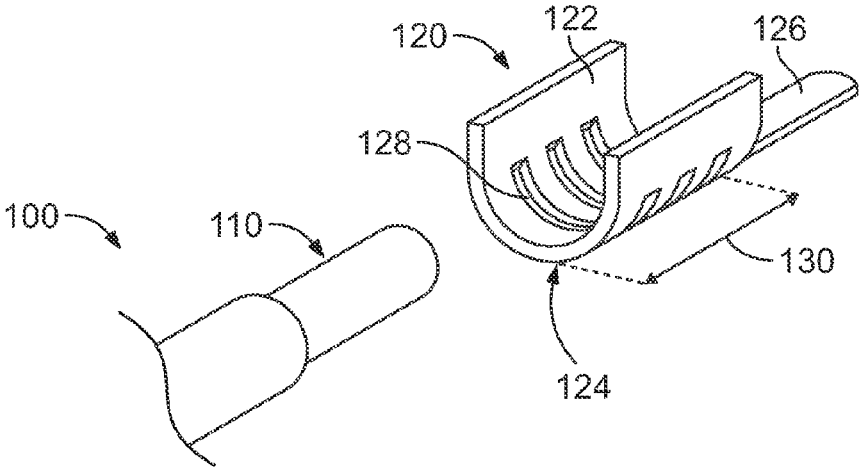
FIG. 3 illustrates the cable poised for termination with a terminal 120.
Figure 4:
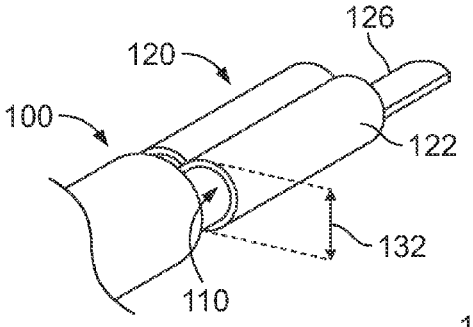
FIG. 4 illustrates the terminal terminated to the cable.

FIG. 3 illustrates the cable 100 poised for termination with a terminal 120. FIG. 4 illustrates the terminal 120 terminated to the cable 100. The cable 100 is illustrated without the EMI shield 106 or jacket 102 (both shown in FIG. 1). The CNT conductor 110 is illustrated in FIGS. 3 and 4.

In an exemplary embodiment, the terminal 120 is configured to be crimped to the CNT conductor 110. The terminal 120 includes a crimp barrel 122 at a termination end 124 thereof. A contact 126 is provided at a mating end of the terminal 120. The contact 126 extends from the crimp barrel 122. In the illustrated embodiment, the contact 126 is a pin contact. The terminal 120 may have other mating interfaces in alternative embodiments, such as a socket, spring beam, faston tab, or other conventional mating interfaces. The terminal 120 may not have any contact in other embodiments, such as a terminal used to splice the ends of two cables 100 together, or a terminal that is used to electrically terminate the EMI shield to a connector, such as around a cylindrical protrusion of a connector.

The crimp barrel 122 may be formed in a U-shape to receive the CNT conductor 110. The edges of the crimp barrel 122 are folded in during the crimping process around the CNT conductor 110 to terminate the terminal 120 to the CNT conductor 110. In the illustrated embodiment, the terminal 120 includes striations 128 defined by grooves or rails that provide surfaces for gripping the CNT conductor 110. Alternatively, the terminal 120 may not include any striations 128. The crimp barrel 122 has a length 130. As shown in FIG. 4, the terminal 120 has a crimp height 132 when crimped to the CNT conductor 110.

To achieve a good mechanical and electrical termination to the CNT conductor 110, the terminal 120 may have different characteristics than a conventional terminal 120 terminated to copper wires. Certain characteristics of the terminal 120 may be varied to achieve a good termination. For example, characteristics such as the base metal of the terminal 120, the length of the crimp barrel 122, the crimp height 132, the size, shape and number of striations, and the like may be variable and selected to achieve a good termination. Changes in one characteristic may affect the other characteristics.

In an exemplary embodiment, because the CNT conductor 110 has a tendency for high compression during the crimp (as compared to copper wire strands), it may be desirable to select a base metal that is stiffer than typical base metals for terminals that crimp to copper wires. For example, the base metal of the terminal 120 may be brass, phosphor-bronze or another base metal that is harder and has less relaxation than copper or copper-alloy terminals. Termination to the CNT conductor 110 should be taken into account when selecting the material from the base metal of the terminal 120.

The length 130 of the crimp barrel 122 has an effect on the mechanical and electrical termination between the CNT conductor 110 and the terminal 120. Having a longer crimp barrel 122 allows for more contact between the CNT conductor 110 and the crimp barrel 122, increasing the mechanical and electrical termination.

The crimp height 132 has an effect on the mechanical and electrical termination between the CNT conductor 110 and the terminal 120. Having a short crimp height may compress the crimp barrel 122 too much, leading to damage of the CNT conductor 110, particularly when the terminal 120 is manufactured from a harder base metal. Having a taller crimp height 132 may lower the mechanical connection therebetween, which may require a longer crimp barrel 122 to accommodate for the weaker mechanically connection.

In an exemplary embodiment, consideration is given to the striations 128 when designing the terminal 120 for termination to the CNT conductor 110, as compared to copper wires. The striations 128 may cause damage to, such as severing of, the CNT strands. The striations 128 may be completely removed to eliminate damage therefrom. Alternatively, the size and shape of the striations 128 may be designed to reduce damage therefrom. For example, the edges of the striations 128 may transition gradually as opposed to having sharp edges.

To enhance the electrical and/or mechanical termination, the CNT conductor 110 and/or the terminal 120 may include conductive intermediaries 140 at the interface between the CNT conductor 110 and the terminal 120. Examples of conductive intermediaries 140 are described below. Other types of conductive intermediaries 140 may be provided in other embodiments.

Figure 5:
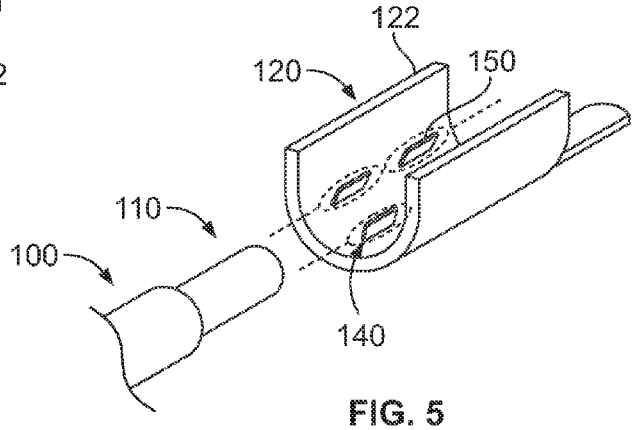
FIG. 5 shows the terminal formed in accordance with an exemplary embodiment.

FIG. 5 shows the terminal 120 formed in accordance with an exemplary embodiment. The terminal 120 has conductive intermediaries 140 in the form of protrusions or fins 150 extending into the receiving space of the crimp barrel 122. The fins 150 are integral with the terminal 120. The fins 150 may be stamped and formed from the terminal 120. The fins 150 may be attached to the terminal 120. The fins 150 may be generally planar structures extending radially outward or outward at other angles from the terminal 120. The fins 150 may be have other shapes, such as mound shapes like bumps extending into the receiving space. The fins 150 may be rigid. The fins 150 may bend or move during crimping.

The fins 150 spread and separate the CNT strands. The strands of the CNT conductor 110 are laced around and between the fins 150 (exemplary paths of the strands around the fins 150 are illustrated in FIG. 5). For example, the exposed end of the CNT conductor 110 may be separable to allow the strands to fit between and around the fins 150. The exposed end of the CNT conductor 110 may naturally fray or splay when cut. The frayed CNT strands may naturally seat in the crimp barrel 122 around the fins 150. The fins 150 engage the CNT strands to increase the surface area of the interface between the terminal 120 and the CNT conductor 110.

Figure 6:
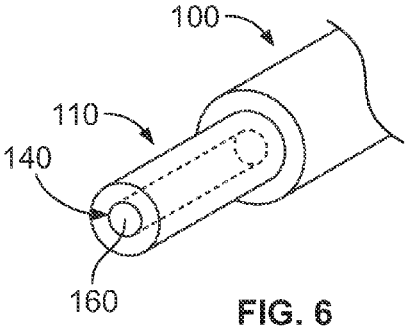
FIG. 6 shows the CNT conductor formed in accordance with an exemplary embodiment.

FIG. 6 shows the CNT conductor 110 formed in accordance with an exemplary embodiment. The CNT conductor 110 has a conductive intermediary 140 in the form of a metal wire 160 loaded into the end of the CNT conductor 110. The wire 160 may be threaded into the CNT conductor 110 or may be pulled into the CNT conductor during the cable forming process. Optionally, the metal wire 160 may extend the entire length of the cable 100 (shown in FIG. 1). The wire 160 is internal of the CNT conductor 110. The wire 160 is surrounded by the CNT strands. The metal wire 160 provides central support for the CNT conductor 110 to support the CNT strands during crimping. The CNT strands electrically engage the wire 160. Optionally, the terminal 120 (shown in FIG. 3) may engage the wire 160 when crimped to the CNT conductor 110. The wire 160 may extend from the CNT conductor 110 and be electrically terminated to the terminal 120 or another component.

Figure 7:
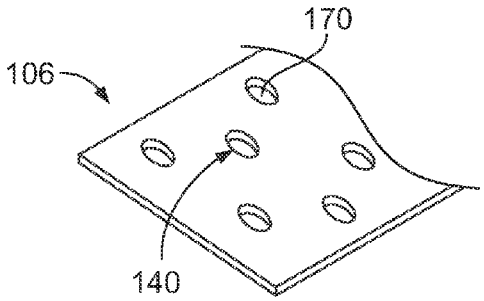
FIG. 7 shows the CNT conductor formed in accordance with an exemplary embodiment.

FIG. 7 shows the CNT conductor 106 (defining the EMI shield 106) formed in accordance with an exemplary embodiment. The CNT conductor 106 has conductive intermediaries 140 in the form of metal fillers 170 loaded into the CNT network. The metal fillers 170 may be metal flakes or other metal fillers. The metal fillers 170 may extend entirely through the CNT network or may extend only partially through the CNT network. The metal fillers 170 are surrounded by the CNT strands. The CNT strands electrically engage the metal fillers 170. When crimped, a terminal may engage the metal fillers 170.

Figure 8:
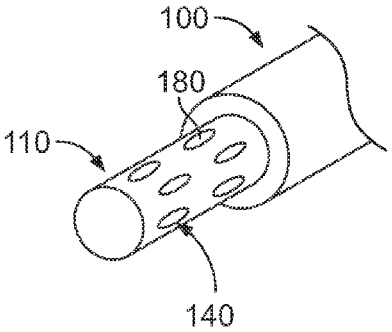
FIG. 8 shows the CNT conductor formed in accordance with an exemplary embodiment.

FIG. 8 shows the CNT conductor 110 formed in accordance with an exemplary embodiment. The CNT conductor 110 has conductive intermediaries 140 in the form of metal fillers 180 loaded into the CNT network, The metal fillers 180 may be metal flakes or other metal fillers. The metal fillers 180 may extend entirely through the CNT network or may extend only partially through the CNT network. The metal fillers 180 are surrounded by the CNT strands. The CNT strands electrically engage the metal fillers 180. When crimped, the terminal 120 (shown in FIG. 3) may engage the metal fillers 180.

Optionally, the metal fillers may be encapsulated pellets. The pellets may hold a conductive substance or particles therein. The pellets may be fractured under mechanical stress, such as when crimped, releasing the conductive substance and creating a bond with the CNT strands and/or the terminal 120. The pellets may be fractured or opened by other means or processes such as application of microwave energy, heat, exposure to another substance and the like. The conductive substance may be in a liquid form. The conductive substance may be malleable and may form to or spread between the CNT strands when heat and/or pressure are applied during the crimping process.

Figure 9:
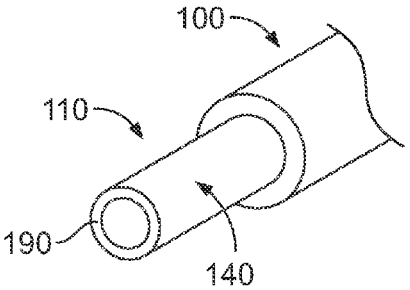
FIG. 9 shows the CNT conductor formed in accordance with an exemplary embodiment.

FIG. 9 shows the CNT conductor 110 formed in accordance with an exemplary embodiment. The CNT conductor 110 has a conductive intermediary 140 in the form of a conductive layer 190 surrounding and/or embedded in the CNT network. The conductive layer 190 may be a plating layer surrounding the CNT conductor 110. The conductive layer 190 may be plating layers surrounding each individual strand. The conductive layer 190 may be a coating applied to the CNT conductor 110. The conductive layer 190 may be a conductive paste. The conductive layer 190 may extend entirely through the CNT network or may extend only partially through the CNT network. The conductive layer 190 engages the CNT strands. The conductive substance may be malleable and may form to or spread between the CNT strands when heat and/or pressure are applied during the crimping process. For example, the conductive layer 190 may be a soft metal such as tin or other solders made of metal alloys that conform and spread into the CNT network when placed under heat and/or pressure. For example, the conductive layer 190 may be made of indium, gallium, a monomeric organic based composite material with metallic fillers, a polymeric organic based composite material with metallic fillers, and the like. When crimped, the terminal 120 (shown in FIG. 3) may engage the conductive layer 190. Optionally, the terminal 120 may include a plating layer to enhance electrical connection between the terminal 120 and the CNT conductor 110.

Figure 10:
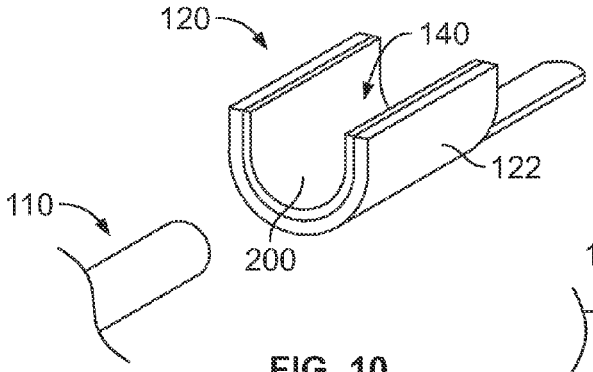
FIG. 10 shows the terminal formed in accordance with an exemplary embodiment.

FIG. 10 shows the terminal 120 formed in accordance with an exemplary embodiment. The terminal 120 has a conductive intermediary 140 in the form of a conductive layer 200 formed on the interior surface of the crimp barrel 122. The conductive layer 200 may be a plating layer. The plating layer may be a precious metal plating, such as gold plating. The plating layer may be a tin plating layer. Optionally, if the conductive layer 200 is formed of a substance that tends to oxidize or form an oxide layer, the conductive layer 200 may be subjected to a process, such as an etching or treating process, to remove the oxide layer for better electrical connection between the base metal of the terminal 120 and the CNT conductor 110. For example, a chemical etching, or chemical treatment of the conductive layer 200 may make the conductive layer 200 more conductive. The conductive layer 200 may be a coating applied to the surface. The conductive layer 200 may be a conductive paste. When the CNT conductor 110 is loaded into the terminal barrel 122, the conductive layer 200 engages the CNT strands. The conductive substance may be malleable and may form to or spread between the CNT strands when heat and/or pressure are applied during the crimping process.

Figure 11:
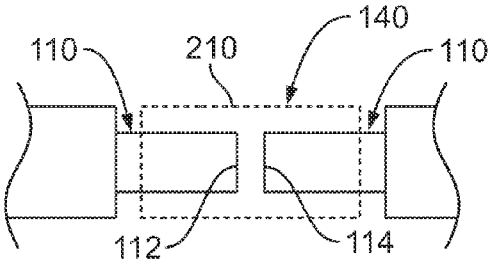
FIG. 11 illustrates ends of two cables being spliced together.

FIG. 11 illustrates ends 112, 114 of two cables 100 being spliced together. A conductive intermediary 140 in the form of a conductive body 210 is applied to the ends 112, 114 of the cables 100. The conductive body 210 may be a layered build-up of coatings applied to the ends 112, 114. The conductive body 210 may be applied as a liquid, such as in a bath. The conductive body 210 may be applied as a paste that is later hardened. The conductive body 210 may be malleable and may form to or spread between the CNT strands when heat and/or pressure are applied. The conductive body 210 may be cured under application of heat, microwave energy, light or chemical reaction with another compound such as a hardener.

Figure 12:
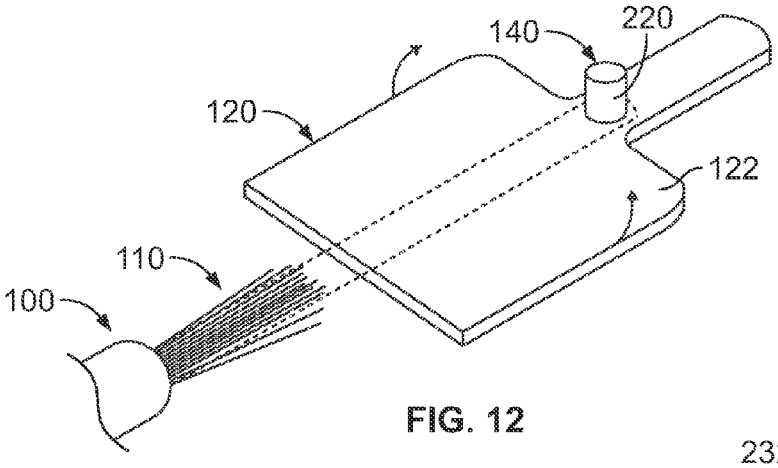
FIG. 12 shows the terminal formed in accordance with an exemplary embodiment.

FIG. 12 shows the terminal 120 formed in accordance with an exemplary embodiment. The terminal 120 has a conductive intermediary 140 in the form of a post 220 extending from the terminal 120 forward of the crimp barrel 122. The post 220 is integral with the terminal 120. The post 220 may be stamped and formed from the terminal 120. The post 220 may be separately attached to the terminal 120.

The CNT conductor 110 is wrapped around the post 220 and doubles back through the crimp barrel 122. The post 220 fits between the folded over strands. Wrapping the CNT conductor 110 around the post provides a mechanical advantage against removal of the CNT conductor 110 from the crimp barrel 122 after crimping. The frayed ends of the CNT strands may be captured within the crimp barrel 122. During crimping, the sides of the crimp barrel 122 are crimped around the CNT conductor 110.

Figure 13:
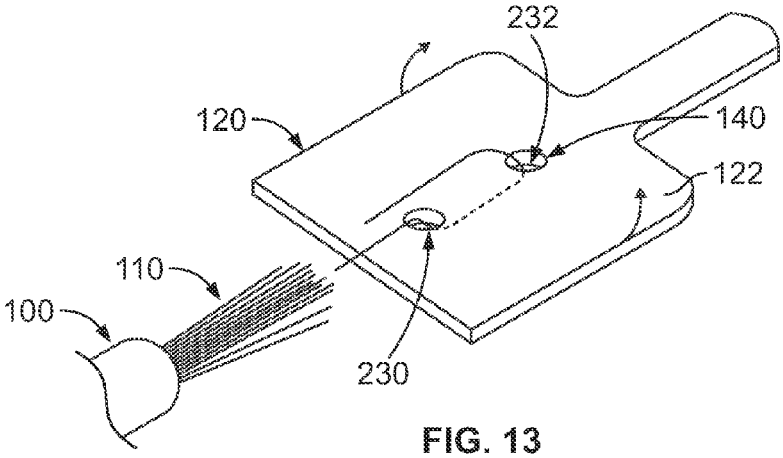
FIG. 13 shows the terminal formed in accordance with an exemplary embodiment.

FIG. 13 shows the terminal 120 formed in accordance with an exemplary embodiment. The terminal 120 has a conductive intermediary 140 in the form of openings 230, 232 through the body of the terminal 120 within the crimp barrel 122. The openings 230, 232 receive the CNT conductor 110. The CNT conductor 110 is laced through the opening 230 and then through the opening 232 back into the crimp barrel. The body of the terminal 120 fits between strands of the CNT conductor 110. The CNT conductor 110 doubles back through the crimp barrel 122. Wrapping the CNT conductor 110 through the openings 230, 232 provides a mechanical advantage against removal of the CNT conductor 110 from the crimp barrel 122 after crimping. The frayed ends of the CNT strands may be captured within the crimp barrel 122. During crimping, the sides of the crimp barrel 122 are crimped around the CNT conductor 110.

Figure 14:
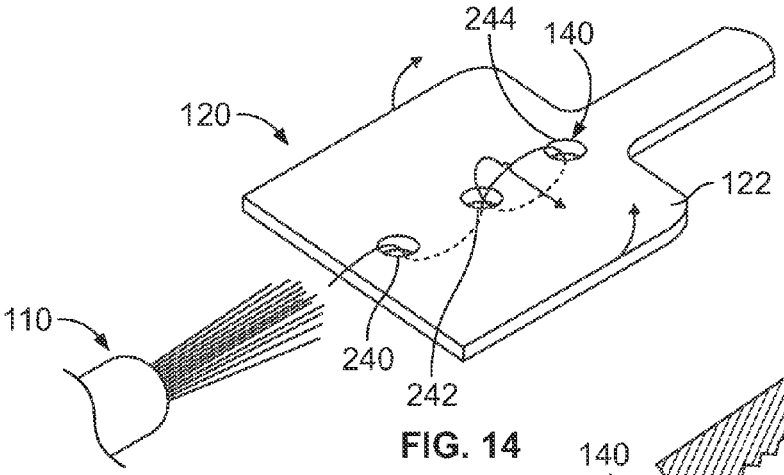
FIG. 14 shows the terminal formed in accordance with an exemplary embodiment.

FIG. 14 shows the terminal 120 formed in accordance with an exemplary embodiment. The terminal 120 has a conductive intermediary 140 in the form of openings 240, 242, 244 through the body of the terminal 120 within the crimp barrel 122. The openings 240, 242, 244 receive the CNT conductor 110. The CNT conductor 110 is laced through the opening 240, through the opening 242 back into the crimp barrel 122, out of the opening 244, back through the opening 242 into the crimp barrel 122 and tied under itself. The body of the terminal 120 fits between strands of the CNT conductor 110. Wrapping the CNT conductor 110 through the openings 240, 242, 244 provides a mechanical advantage against removal of the CNT conductor 110 from the crimp barrel 122 after crimping. The frayed ends of the CNT strands may be captured within the crimp barrel 122. During crimping, the sides of the crimp barrel 122 are crimped around the CNT conductor 110.

Figure 15:
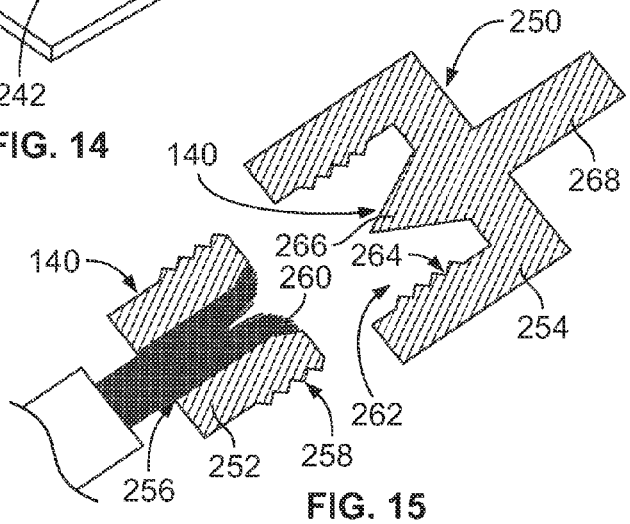
FIG. 15 illustrates a terminal formed in accordance with an exemplary embodiment.

FIG. 15 illustrates a multi-piece terminal 250 having an inner body 252 and an outer body 254. The inner body 252 receives the CNT conductor 110 through an opening 256. The inner body 252 and/or outer body define a conductive intermediary 140. The inner body 252 has external threads 258. The inner body 252 has angled surfaces 260 at the front of the inner body 252. The CNT strands of the CNT conductor 110 engage the angled surfaces 260 to electrically connect the CNT conductor and the inner body 252.

The outer body 254 has a chamber 262 that receives the inner body 252. The walls of the chamber 262 have internal threads 264 that threadably engage the external threads 258 of the inner body to secure the inner body 252 to the outer body 254. Other types of securing features may be used in alternative embodiments. A wedge 266 extends into the chamber 262. The wedge 266 defines a conductive intermediary 140. The wedge 266 is driven into the CNT conductor 110. The wedge 266 splits the CNT strands and presses the CNT strands against the angled surfaces 260. A mechanical and electrical connection is made between the CNT strands and both the inner and outer bodies 252, 254. A contact 268 extends from the outer body 254.

Figure 16:
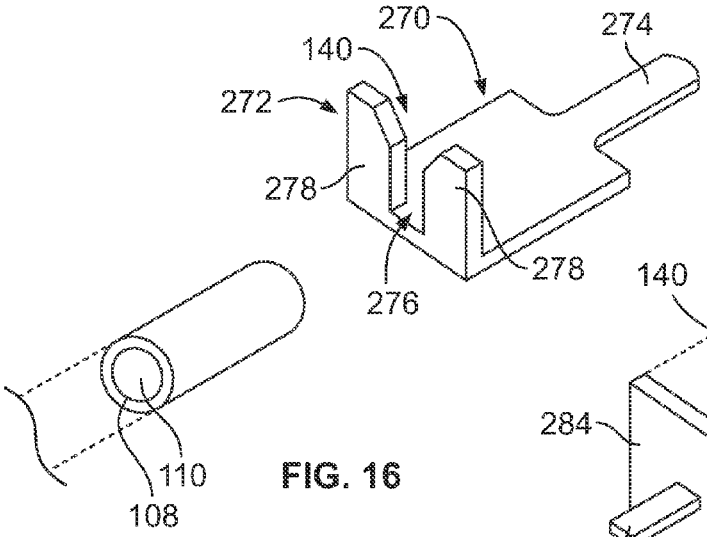
FIG. 16 illustrates a terminal formed in accordance with an exemplary embodiment.

FIG. 16 illustrates a terminal 270 having an insulation displacement contact (IDC) 272 at one end and a mating contact 274 at the opposite end. The IDC 272 receives the CNT conductor 110 through an opening 276. The IDC 272 has two blades 278 that pierce the insulator 108 to engage the CNT conductor 110. The blades 278 define conductive intermediaries 140. The blades 278 press against the CNT conductor 110 to ensure electrical contact therewith. The finish on the blades 278 may be dull so as to not slice or damage the CNT strands. The finish on the blades 278 may be made of a soft material that can be deformed, reflowed and/or liquidized under pressure, heat, microwave energy, due to self induced heat generated from friction and the like. Such deformation/reflow/liquidization may conform and/or spread into the CNT network to enhance the electrical and/or mechanical connection.

Figure 17:
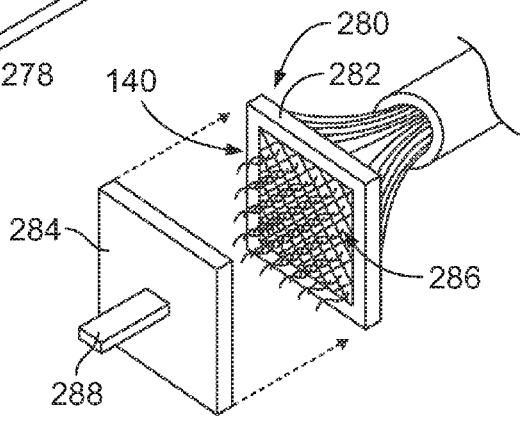
FIG. 17 illustrates a terminal formed in accordance with an exemplary embodiment.

FIG. 17 illustrates a multi-piece terminal 280 having an inner body 282 and an outer body 284. The inner body 282 has a screen 286 that receives the frayed strands of the CNT conductor 110 through screen openings. The screen 286 defines a conductive intermediary 140. The outer body 284 is pressed against the inner body 282. The CNT strands are captured between the inner and outer bodies 282, 284. A mechanical and electrical connection is made between the CNT strands and both the inner and outer bodies 252, 254. A contact 288 extends from the outer body 284.

Embodiments described herein provide robust termination methods and components for CNT conductors. Embodiments have features that aid in providing an electrical and mechanical connection between a terminal and a CNT conductor.

Mechanical adjustments to the design of a crimp can enable the CNT mechanical and electrical performance. Mechanical improvements include modifying design of striations, modifying the length of the crimp barrel and adjusting the height recommendation. Performance of the crimp can also be improved by changing the base metal of the crimp, which will modify the effective impact stress on the CNT structure.

Mechanical and electrical contact of CNT structures to metal terminals requires intimate contact between the metal and the CNT structure. Depending on the form of the CNT macrostructure, embodiments provide a feature within the crimp terminal either by plating or through stamping. The structure can be rigid and designed to separate and/or spread the CNT structure. The feature could be a stamped feature of the basic terminal that may be further formed during the crimping process. The feature could be a soft malleable coating that would conform and spread into the CNT structure mechanically when placed under heat and/or pressure. The addition of metal could be to the CNT macrostructure prior to the termination. The addition of metal could be accomplished physically, such as threading a metallic wire through the structure. The addition of metal could be accomplished via an intimate bond such as plating.

Mechanical and electrical contact of CNT structures to metal terminals requires intimate contact between the metal and the CNT structure. Depending on the form of the CNT macrostructure, embodiments apply a feature within the crimp terminal by processes such as, but not limited to plating or stamping. The structure could be soft malleable coating, such as a soft metal such as tin or other solders made of metal alloys that would conform and spread into the CNT structure mechanically when placed under heat and/or pressure. The addition of metal could be added to the CNT macrostructure prior to the termination. The addition of metal could be accomplished physically, such as threading a metallic wire through the structure or accomplished via an intimate bond such as plating.

Mechanical and electrical contact of CNT structures to metal terminals requires intimate contact between the metal and the CNT structure. Depending on the form of the CNT macrostructure, embodiments apply a feature within the crimp terminal by processes such as dispersion of liquid or application of paste. The structure could be soft malleable coating, such as suspension of particles of tin, or other solders made of metal alloys and/or soft metals such as In, Ga, or a organic (monomeric, polymeric) based composite material that is rendered electrically or thermally conductive by inclusion of metallic particles that would conform and spread into the CNT structure mechanically when placed under external pressure and cure solid under application of heat, microwave energy, light, or chemical reaction with another compound such as hardener. The addition of metal could also be a liquid metal or metallic particle dispersed in a solution that is encapsulated within a polymer. Under stress such as mechanical, heat, microwave, and the like, the encapsulant would fracture releasing the solution and creating the bond. The addition of metal could be added to the CNT macrostructure prior to the termination. The addition of metal could be accomplished physically, such as threading, co-braiding, metallic fibers or wires through the structure or accomplished via an intimate bond such as plating.

The lack of abrasion resistant and tendency to fray of CNT macrostructures create unique issues which can cause issues in termination designed to withstand both electrical and mechanical performance. Embodiments overcome this issue is by using a looping and/or pin interface within the termination. Embodiments include a stationary terminal element wrapped around with CNT macrostructure prior to crimping. Embodiments include a terminal post with a figure eight. Embodiments include a terminal loop with CNT macrostructure wrapped around and mechanically attached using techniques such as crimping or knotting afterwards. Embodiments include a plate, metallic or other material that is rigid in nature, which is than threaded with a CNT conductor. The structure could be self tightening or contain a feature such as a crimp.

Embodiments of termination of CNT macrostructures include a multi-piece terminal design which will create a pressure fit. The termination can be achieved by a swaging operation involving different pieces within the design. A blade having a soft finish is used to create the pressure. The blade may operate in different shapes including but not limited to knife edge, a screen, a ring, or cone shape. The pressure may be applied by a secondary, or multiple additional elements, which are used to help seat the CNT macrostructure and blade. The seating elements may include an interlocking feature such as a tread, external screws or clamps. The finish on the blade or the seating element could include a material that will not fray or cut the CNT macrostructure but may be required to displace the insulation on the macrostructure. The finish on the blade or on the seating element could be made of softer material than a bulk of that component. The finish layer could be deformed, re-flowed, or liquidized under application of pressure, heat, light, or microwave energy, or due to self-induced heat generated by friction. The finish material could conform and/or spread into the CNT structure.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a carbon nanotube (CNT) conductor;

a terminal terminated to the CNT conductor, the terminal having a crimp barrel that receives the CNT conductor; and a conductive intermediary electrically coupled to the CNT conductor and the terminal to enhance an electrical connection between the CNT conductor and the terminal, the conductive intermediary comprising a post extending from the terminal, the CNT conductor being wrapped around the post and doubled back into the crimp barrel.

2. The electrical connector of claim 1, wherein the conductive intermediary comprises a soft metal that conforms to and spreads into the CNT conductor, the conductive intermediary being applied to at least one of the crimp barrel and the CNT conductor.

3. The electrical connector of claim 1, wherein the conductive intermediary comprises a conductive paste on at least one of the crimp barrel and the CNT conductor.

4. The electrical connector of claim 1, wherein the conductive intermediary comprises a soft metal that conforms to and spreads into the CNT conductor, the conductive intermediary being applied to at least one of the crimp barrel and the CNT conductor.

5. The electrical connector of claim 1, wherein the conductive intermediary comprises a conductive paste on at least one of the crimp barrel and the CNT conductor.

6. The electrical connector of claim 1, wherein the conductive intermediary comprises a conductive layer on at least one of the crimp barrel and the CNT conductor.

7. The electrical connector of claim 6, the conductive layer being malleable and being formed into the CNT conductor when heat and/or pressure is applied to the conductive layer.

8. An electrical connector comprising:

a carbon nanotube (CNT) conductor;

a terminal terminated to the CNT conductor, the terminal having a crimp barrel that receives the CNT conductor; and a conductive intermediary electrically coupled to the CNT conductor and the terminal to enhance an electrical connection between the CNT conductor and the terminal, the conductive intermediary comprising openings in the crimp barrel through a body defining the terminal, the CNT conductor being laced into and out of the crimp barrel through the openings.

9. The electrical connector of claim 8, wherein the conductive intermediary comprises a conductive layer on at least one of the crimp barrel and the CNT conductor.

10. The electrical connector of claim 9, the conductive layer being malleable and being formed into the CNT conductor when heat and/or pressure is applied to the conductive layer.

* * * * *